US006691631B2

(12) United States Patent
Pettigrew et al.

(10) Patent No.: US 6,691,631 B2
(45) Date of Patent: Feb. 17, 2004

(54) TRANSPARENT TEMPLATE FOR FACILITATING EMBROIDERY ALIGNMENT USING A SUPPORT FRAME OF A SEWING MACHINE

(76) Inventors: Victoria I. Pettigrew, 18640 Castle Lake Dr., Morgan Hill, CA (US) 95037; Stephen H. Pettigrew, 18640 Castle Lake Dr., Morgan Hill, CA (US) 95037

( * ) Notice: Subject to any disclaimer, the term of this patent is extended or adjusted under 35 U.S.C. 154(b) by 452 days.

(21) Appl. No.: 09/825,205

(22) Filed: Apr. 2, 2001

(65) Prior Publication Data

US 2001/0042497 A1 Nov. 22, 2001

Related U.S. Application Data

(63) Continuation of application No. 09/573,494, filed on May 16, 2000, now Pat. No. 6,240,864.

(51) Int. Cl.[7] ..... D05C 9/22
(52) U.S. Cl. ..... 112/475.18; 112/103
(58) Field of Search ..... 112/475.18, 103, 112/131, 100, 306, 470.01, 24; 38/102.2; 428/42.1, 914

(56) References Cited

U.S. PATENT DOCUMENTS

| | | | | | |
|---|---|---|---|---|---|
| 889,614 | A | * | 6/1908 | Johnsen | 112/439 |
| 4,762,076 | A | * | 8/1988 | Wakaizumi | 112/103 |
| 4,774,778 | A | * | 10/1988 | Williams | 112/78 |
| 5,899,160 | A | * | 5/1999 | Hoag | 112/103 |
| 5,992,339 | A | * | 11/1999 | Mack | 112/103 |
| 6,240,864 | B1 | * | 6/2001 | Pettigrew et al. | 112/103 |

* cited by examiner

*Primary Examiner*—Ismael Izaguirre
(74) *Attorney, Agent, or Firm*—Silicon Valley IP Group, LLC.; Kevin J. Zilka

(57) ABSTRACT

An apparatus and method are provided including a sheet formed of a transparent material. The sheet defines a template capable of having a pattern printed thereon. During use, the template is adapted for being removed from the sheet. Also included is at least a pair of alignment designators that are positioned on the template of the sheet for marking the material. The markings facilitate alignment of the material in a support frame that is adapted for use when embroidering the pattern on the material.

11 Claims, 8 Drawing Sheets

TRANSPARENT TEMPLATE FOR FACILITATING EMBROIDERY ALIGNMENT USING A SUPPORT FRAME OF A SEWING MACHINE

The present application is a continuation of a patent application filed May 16, 2000 under Ser. No. 09/573,494 and issued as U.S. Pat. No. 6,240,864.

FIELD OF THE INVENTION

Background of the Invention

Embroidery is a commonly used technique for providing an infinite variety of singly or multiply colored stitched pattern and pictorial enhancements to wearing apparel and other articles constructed of textiles and other lightweight materials. Embroidery involves the stitching of thread into a selected cloth substrate such as a coat, sweatshirt, sheet material, or the like. By appropriately choosing various threads having different colors and by carefully intermingling such stitched threads, patterns can be created which are extremely attractive, expensive in appearance and suitable for fashionable designer apparel.

With the development of readily available and sophisticated computing hardware and software for controlling embroidery equipment and machinery, the manufacture and production of such enhanced products has been automated whereby such articles are now produced at costs substantially reduced from those of articles previously produced without the benefit of such automation. One example of such system includes a sewing machine coupled to a computer. In operation, the computer is adapted to allow a user to select a pattern, and control the sewing machine for embroidering the pattern on an article. Support frames are commonly used to fix the article in place with respect to the sewing machine during embroidering.

In order to prepare an article for embroidery, the support frame may take the form of a pair of hoops which secure the article beneath the sewing heads of the sewing machine. Tubular hoops are traditionally comprised of a larger and a smaller close-loop section. The larger hoop is called the female hoop portion and is sized so as to frictionally receive in its inner diameter the smaller hoop, which is called the male portion. The hoops are used to secure and to stretch a portion of an article that is to be embroidered.

As is known, the portion of the article to be embroidered is placed between the male and female hoop portions. Once the portion of the article to be embroidered is properly framed by the hoop portions, the male hoop portion is seated within the female hoop portion, thereby catching a portion of the article between the inner diameter of the female hoop portion and the outer diameter of the male hoop portion. The article is retained between the hoop portions by the friction fit of the hoop portions, the magnitude of the friction force being enhanced by the added thickness of the article caught therebetween.

It is the practice of established embroidering methods to provide an attachment mechanism upon one of the hoop portions, generally the female hoop portion, so as to permit the hoop portions and the article secured therebetween, to be secured to the sewing machine for the embroidery operation.

However, a major problem exists in the use of such tubular hoops. Because the methods and devices heretofore used for positioning an article between the male and female hoop portions have been neither accurate nor precise, the number of flawed articles turned out by embroidery processes has been high. Quite often an article is improperly secured between the male and female hoop portions, resulting in the embroidery being in the wrong position or in being misaligned or skewed. As embroidery is for all intents and purposes permanent, each flawed article represents a loss to the embroiderer.

Another problem that exists in the process of using tubular hoops in the embroidery process is the amount of time necessary to properly secure an article between the male and female hoop portions. It is difficult and very time consuming to measure by hand the proper positioning and alignment for a hoop on an article. Moreover, when measuring by hand it is very easy to make a mistake. Placing the article between the hoops by sight is much faster, but results in far more mistakes and incurred cost. The problem with many of the devices of the prior art is that they incorporate far too many steps that are carried out by hand measurement or by sight alone. Not only does using the hooping devices of the prior art require too much time, but there is also a higher risk of error.

As set forth earlier, one common challenge associated with embroidering includes aligning a pattern on an article. If not done properly, the subject article may be rendered defective and undesired. Prior art FIG. 1 illustrates an exemplary article including a shirt 100 having a pocket 102 thereon. During use, a support frame may be attached to the pocket 102. The support frame is in turn attached to a sewing machine which is capable of embroidering a pattern so that it is centered with respect to the support frame.

Prior art FIG. 2 illustrates a support frame 200 removably attached to the pocket 102 of the shirt 100 shown in FIG. 1. As is readily apparent, it is extremely important to center the support frame 200 on the pocket 102 to ensure that the pattern is later centered properly with respect to the pocket 102. This is often very difficult to accomplish since the support frame must be positioned on the pocket without knowing how the pattern will appear thereon. As a result, any slight rotation of the support frame 200 or deviation of the center of the support frame 200 with respect to the center of the pocket 102 will result in the pattern being misaligned.

Prior art FIG. 3 illustrates the pocket 102 with a pattern 300 embroidered after misalignment of the support frame 200. As shown, any slight change in the angle of rotation or center deviation results in misalignment. There is thus a need for an apparatus and method that facilitates the alignment of patterns on various articles, and further facilitates the overall embroidery process.

DISCLOSURE OF THE INVENTION

An apparatus and method are provided including a sheet formed of a transparent material. The sheet defines a template capable of having a pattern printed thereon. During use, the template is adapted for being removed from the sheet. Also included is at least a pair of alignment designators that are positioned on the template of the sheet for marking the material. The markings facilitate alignment of the material in a support frame that is adapted for use when embroidering the pattern on the material.

In one embodiment of the present invention, the sheet may have a substantially rectangular configuration and be substantially flexible for facilitating the printing of the pattern on the template of the sheet using a printer. To facilitate the removal of the template from the sheet, a periphery of the template may be perforated. Further, the alignment designators may include cut outs formed in the template of the sheet.

In another embodiment of the present invention, a label may be adhered to the sheet for allowing a printer to print information relating to the pattern thereon. Such label may be removably positioned on the sheet for re-positioning on the template. This ensures that the information is conveniently accessible during subsequent uses of the template. Yet another option includes equipping a periphery of the template of the sheet with a size and a shape similar to that of the support frame in order to further facilitate embroidery alignment.

The method associated with use of the present invention includes printing a pattern on the template formed from the sheet of transparent material. The template may then be removed from the sheet and positioned on a piece of material. Thereafter, the material is marked using at least a pair of alignment designators that are positioned on the template. Such markings on the material are then aligned with a support frame for attachment purposes when embroidering the pattern on the material.

These and other advantages of the present invention will become apparent upon reading the following detailed description and studying the various figures of the drawings.

BRIEF DESCRIPTION OF THE DRAWINGS

The foregoing and other aspects and advantages are better understood from the following detailed description of a preferred embodiment of the invention with reference to the drawings, in which.

Prior art

Prior art

Prior art

DESCRIPTION OF THE PREFERRED EMBODIMENTS

Figure 1:
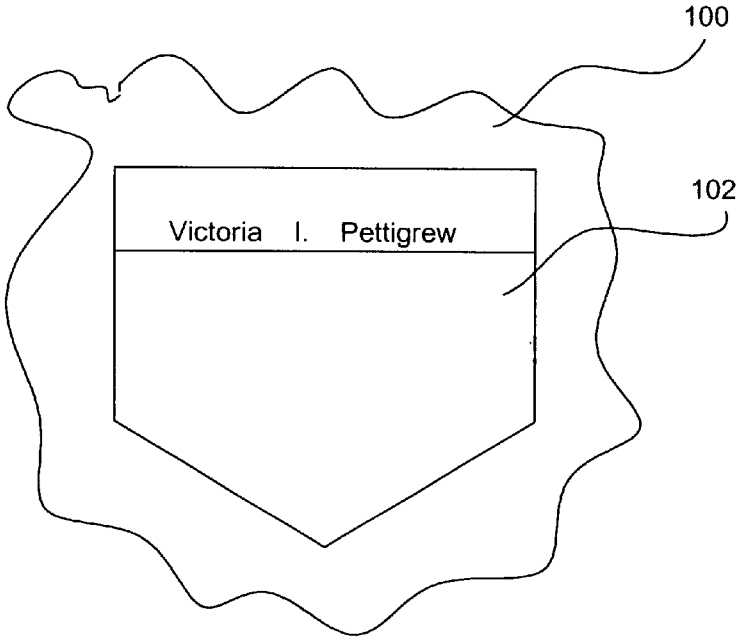
FIG. 1 illustrates an exemplary article including a shirt having a pocket thereon.
Figure 2:
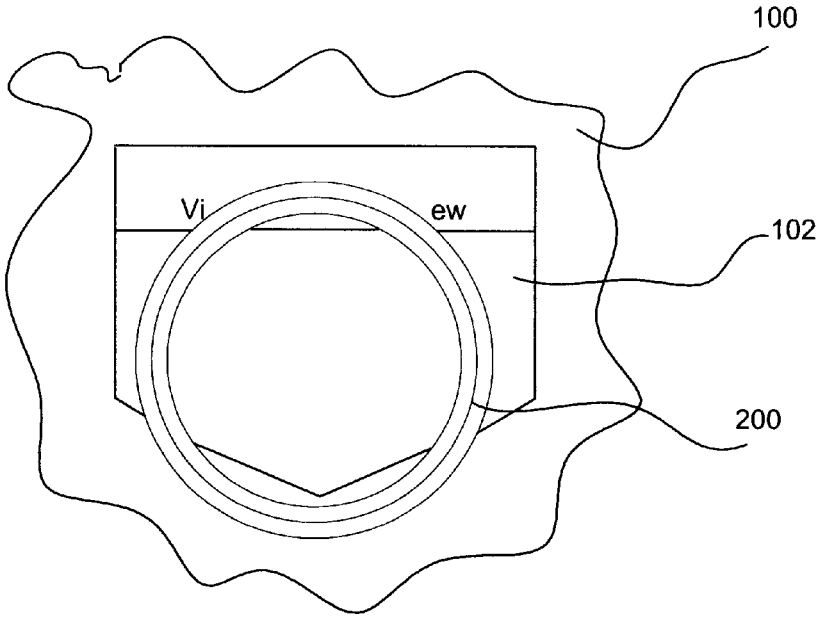
FIG. 2 illustrates a support frame removably attached to the pocket of the shirt shown in FIG. 1.
Figure 3:
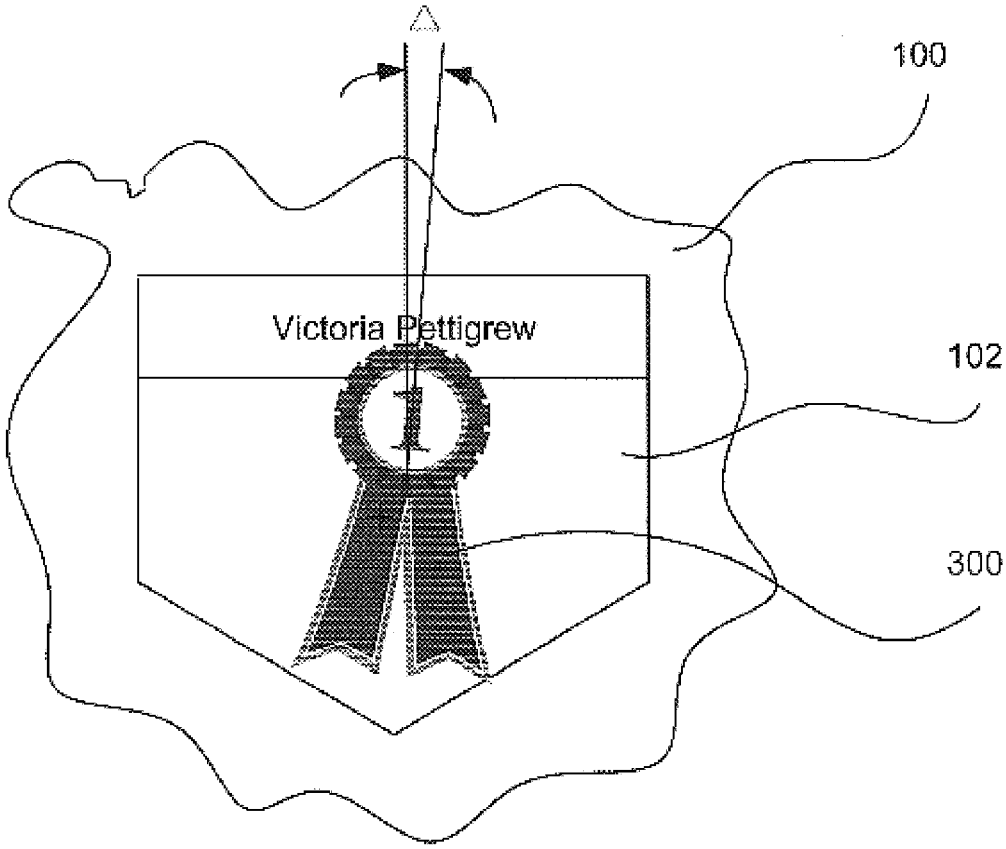
FIG. 3 illustrates a pocket with the pattern embroidered after misalignment of the support frame.
Figure 4:
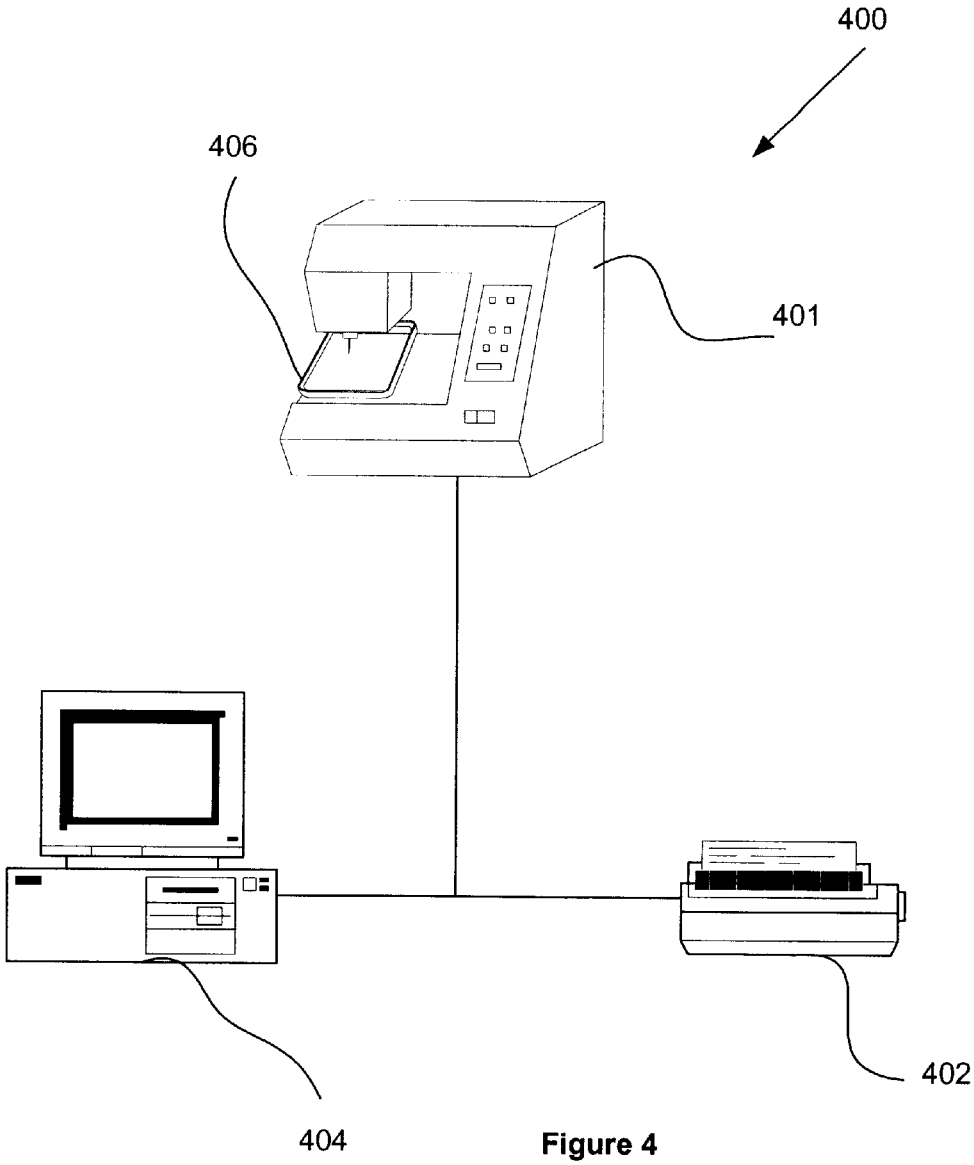
FIG. 4 illustrates a system including a sewing machine, computer, and printer which are adapted for use with the present invention.

FIGS. 1–3 illustrate the prior art. FIG. 4 illustrates a system 400 including a sewing machine 401, computer 404, and printer 402 which are adapted for use with the present invention. As shown, the sewing machine 401 is detachably connected to the computer 404 which is in turn detachably connected to the printer 402. Also attached to the sewing machine 401 is a removable support frame 406 with a substantially square configuration. In one embodiment, the support frame 406 may include an inner section which is removably coupleable to an outer section for allowing material to be supported therebetween. Such material may take on any form including, but not limited to cloth, plastic, or any other material capable of being processed by the sewing machine 401.

In operation, a user may create, edit and view various patterns on a display of the computer 402. Upon selection of a desired pattern, the computer 402 may be used to print the pattern utilizing the printer 402 for the purpose of generating a template. In various alternate embodiments, the computer 404 and the various functions associated therewith may be incorporated into the sewing machine 401 and/or the printer 402.

One embodiment of the present invention involves a new template apparatus and method for use with system 400 shown in FIG. 4. In use, the template of the present invention solves the problems set forth earlier relating to embroidery misalignment, in addition to providing other features that facilitate the overall use of the system 400.

Figure 5:
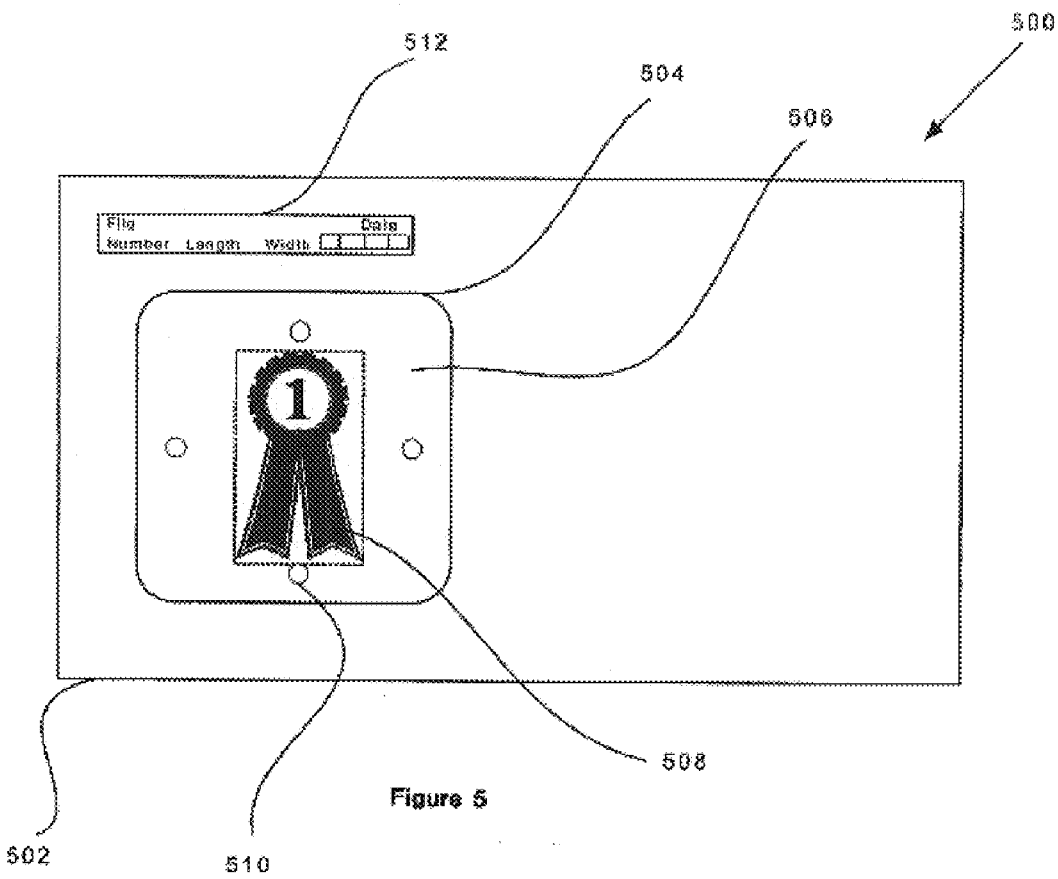
FIG. 5 is a top view of a template apparatus that is capable of being used with the system of FIG. 4.

FIG. 5 is a top view of an apparatus 500 that is capable of being used with the system 400 of FIG. 4. As shown, a thin sheet 502 is provided with a substantially rectangular configuration. Such sheet 502 has a top face, a bottom face, and a periphery formed therebetween. The periphery is defined by a pair of elongated side edges and a pair of short end edges. In one embodiment, the sheet 502 is formed of a transparent, flexible material. As will soon become apparent, the sheet 502 is specifically tailored for being positioned into the printer 402 for having a pattern printed thereon. For example, the sheet 502 may optionally have a width dimension substantially equal to 8 and ½ inches. While not necessary, the length dimension may optionally be substantially equal to 11 inches.

Also included is a closed-loop perforation 504 formed in the sheet 502 within the periphery thereof Such perforation 504 defines a template 506 that is removable from the sheet. In an alternate embodiment, the sheet 502 may include just indicia to define the template 506, thus allowing a user to user to utilize a tool such as a scissors or knife to separate the template 506 from the sheet 502. In yet another embodiment, the sheet 502 may be pre-sized and shaped to define the template 506 in order to avoid any of the above separation techniques.

In one embodiment, the template 506 may be equipped with a peripheral edge defined by four side edges of a size and a shape corresponding to that of the support frame 406 shown in FIG. 4. It should be understood that the template 506 may take on any shape or size. For example, the templates may be sized to match various standard sizes of support frames 406. In use, the template 506 is adapted for receiving a pattern 508 thereon. The pattern may take the form of a geometric arrangement, decoration (logo, identifier, etc.), or any other indicia.

With continuing reference to FIG. 5, four circular cut outs 510 are formed in the sheet 502 within the bounds of the peripheral edge of the template 506. Each cut out 510 is formed adjacent to a central extent of a corresponding one of the side edges of the template 506. For reasons that will soon become apparent, the cut outs 510 are adapted for allowing a user to mark an underlying piece of material with a chalk material or the like. This allows the pattern 508 to be aligned on the material prior to the material being attached to the support frame 406.

In various alternate embodiments, the cut outs 510 may take on any number, shape, or form. In the alternative, notches may be formed in the peripheral edge of the template 506 for serving a similar function. It should be understood that any type of alignment designators may be used which is capable of allowing the material to be marked for alignment purposes. For example, the alignment designators may include pre-printed indicia, or indicia printed by the printer 402. In order for the alignment designators to be properly positioned with respect to the pattern, special attention may be given so that the periphery of the sheet 502 is a standard size and shape such that the printer 402 consistently prints the pattern in a central location between the alignment designators.

Adhered to the top face of the sheet 502 is a removable opaque label 512 that is positioned adjacent to one of the end edges. As shown in FIG. 5, the label 512 extends adjacent to and in parallel with one of the side edges of the periphery of the sheet 502. During operation, the label 512 is adapted for being removed from the sheet 502, and re-adhered to the template 506 within the peripheral edge thereof.

The label 512 functions to convey various information such as the file name under which the pattern 508 is stored on the computer 404, the date in which the pattern 508 was last saved in the computer 404, the color scheme associated with the pattern 508, and/or any other type of information relating to the pattern 508. As is known in the art, the color scheme allows a user to decipher what color the various portions of the pattern 508 are to be embroidered.

Figure 6:
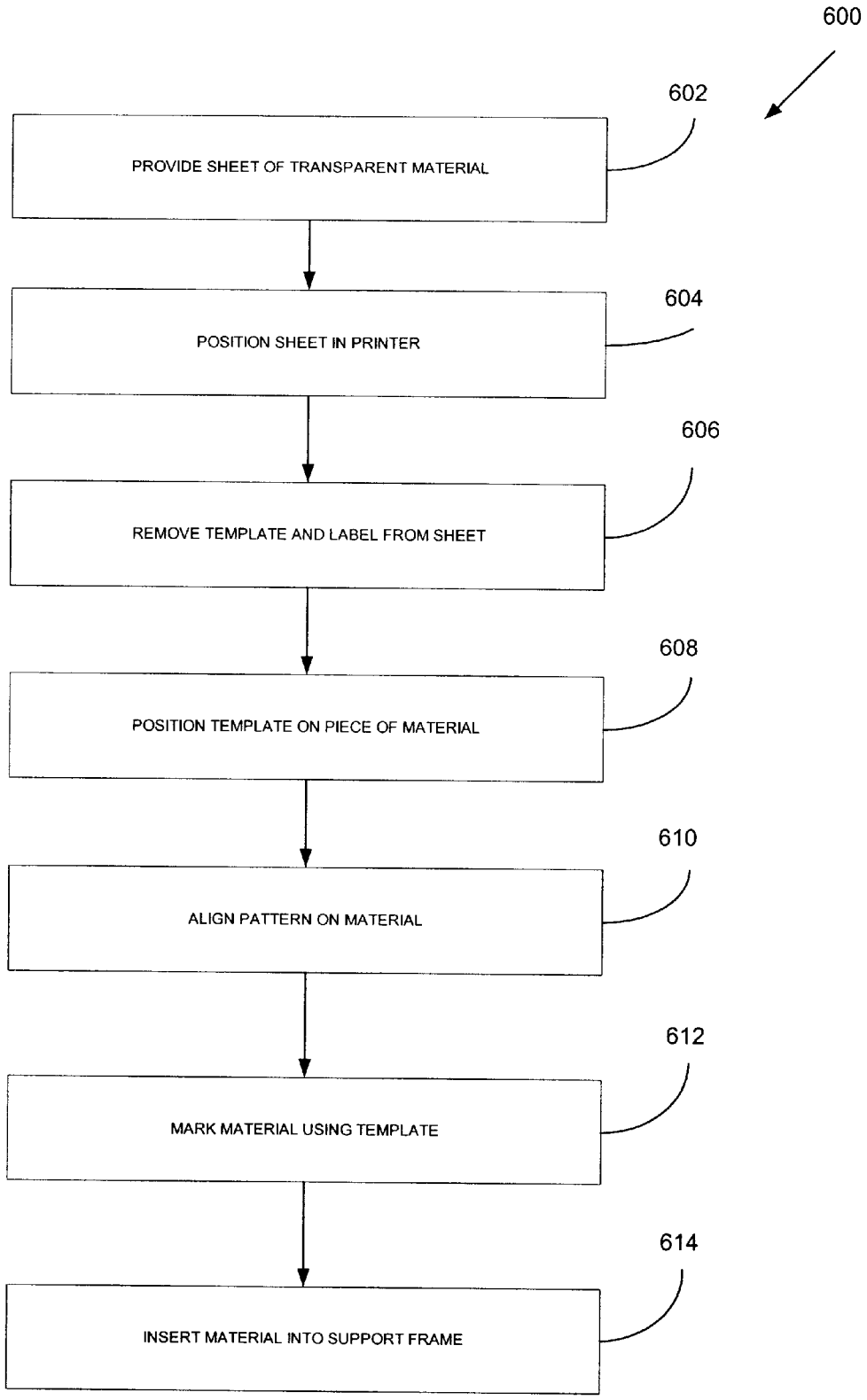
FIG. 6 is a flowchart illustrating the method for facilitating embroidery alignment in accordance with one embodiment of the present invention.

FIG. 6 is a flowchart illustrating the method 600 for facilitating embroidery alignment in accordance with one embodiment of the present invention. As shown, the sheet 502 of transparent material is provided in operation 602. As set forth earlier, the sheet 502 has a template 506 formed thereon. Next, in operation 604, the sheet 502 is positioned in the printer 402, and the pattern 508 is printed on the template 506 of the sheet 502 using a computer program. During such printing step, various information is also printed on the label 512 of the sheet. Resulting is the sheet 502 shown in FIG. 5.

Figure 7:
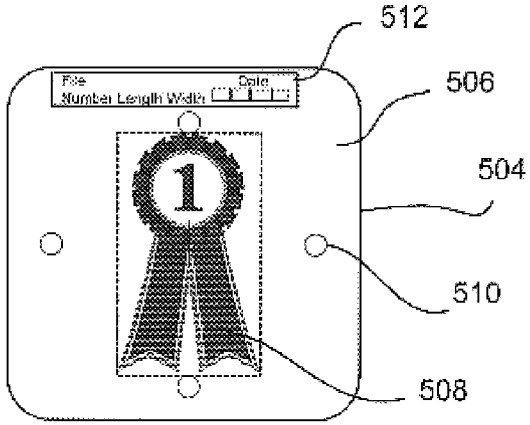
FIG. 7 illustrates the manner in which the label is adhered to the template in accordance with one embodiment of the present invention.
Figure 8:
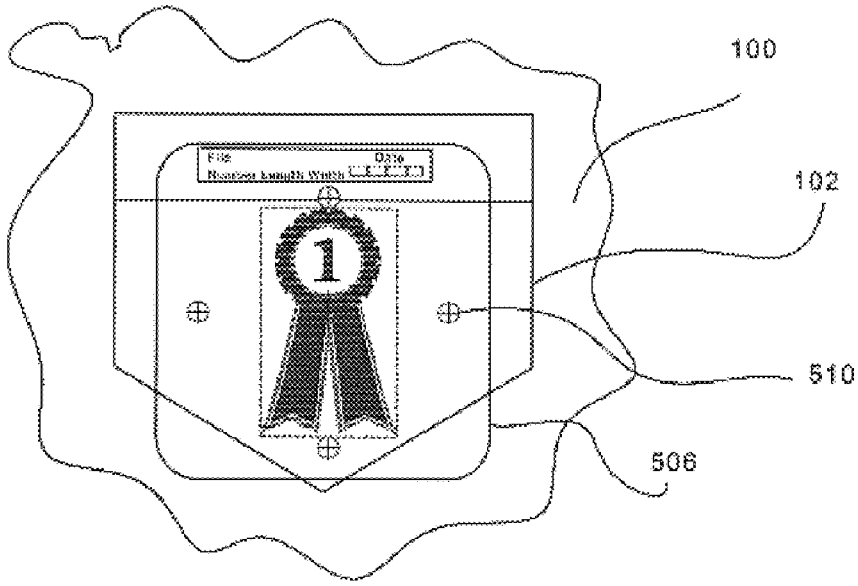
FIG. 8 illustrates the alignment of the template on an article, and the marking of the article in accordance with one embodiment of the present invention.

Next, the template 506 and label 512 are removed from the sheet 502 in operation 606. The label 512 is then adhered to the template 506 in a manner shown in FIG. 7. This allows convenient access to the information during subsequent use of the template 506. Thereafter, the template 506 is positioned on a piece of material in operation 608, and the pattern 508 is aligned on the material in a desired manner, as indicated in operation 610. It should be noted that the transparency of the template 506 facilitates this process by permitting the user to see the precise location of the pattern on the material. FIG. 8 illustrates the alignment of the template 506 on the material.

As set forth earlier, at least a pair of cut outs 510 are positioned on the template 506. In operation 612, such cut outs 510 are used for marking the material. FIG. 8 illustrates the marking of the article through the cut outs 510.

Figure 9:
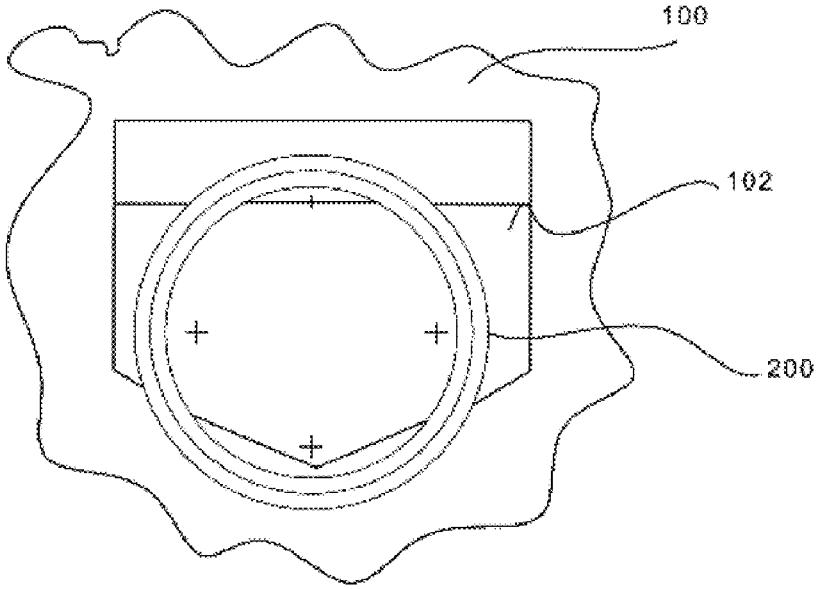
FIG. 9 illustrates the alignment of the support frame with the markings on the article.

With the material marked, the material is then ready to be attached to the support frame 406. During such attachment, the markings on the material are used to ensure that the material is positioned in the support frame 406 such that the pattern is embroidered thereon in proper alignment. Note operation 614. FIG. 9 illustrates the alignment of the support frame 406 with the markings on the article. As shown, an apex of the support frame 406 may be aligned with an uppermost marking, and the remaining markings may be aligned accordingly.

While not necessary, the support frame 406 may include alignment indicators at ninety (90) degree increments to facilitate alignment with the markings on the material. It should be noted that the operations set forth in FIG. 6 may be repeated with multiple templates on a single article as desired so that multiple patterns can be properly aligned relative to each other.

Figure 10:
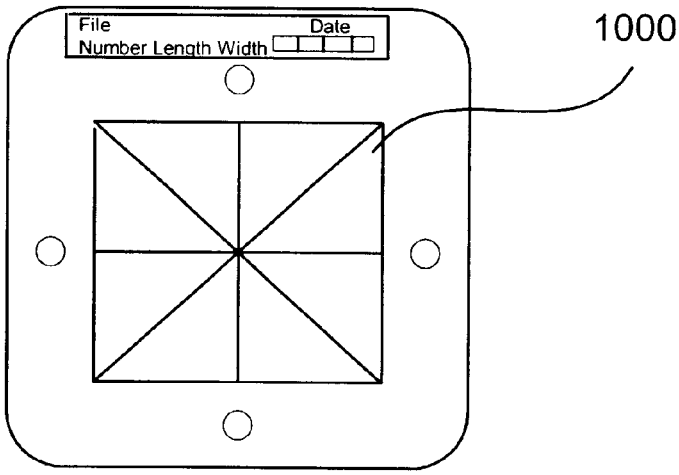
FIG. 10 illustrates an alternate embodiment of the present invention including a pattern taking the form of a geometric arrangement.

FIG. 10 illustrates an alternate embodiment of the present invention including a pattern taking the form of a geometric arrangement 1000 in lieu of decorative indicia. In one embodiment, the geometric arrangement 1000 may include cross-hairs, or any other type of pattern than allows a user to mark the article such that the pattern is centered where the arrangement 1000 is positioned during alignment.

As mentioned earlier, the templates 506 may be sized to match various standard sizes of support frames 406. In an alternate method, the embodiment of FIG. 10 may also be used for allowing larger hoops to be used with templates 506 having alignment designators tailored for smaller support frames 406. It is readily apparent that alignment designators spaced to fit within a smaller support frame 406 would position the markings in a manner that would frustrate the alignment process using a larger support frame 406. If the template 506 of FIG. 10 is equipped for use with a larger support frame 406, the arrangement 1000 of the larger template 506 may be aligned with the markings previously made using a smaller template 506 for generating additional markings. Thereafter, the additional markings on the material may be used to accurately align with the larger support frame 406. In the alternative, the larger template 506 may be physically positioned within the support frame 406 for alignment with the markings resulting from the smaller template 506.

While various embodiments have been described above, it should be understood that they have been presented by way of example only, and not limitation. Thus, the breadth and scope of a preferred embodiment should not be limited by any of the above described exemplary embodiments, but should be defined only in accordance with the following claims and their equivalents.

What is claimed is:

1. An apparatus, comprising:

a sheet adapted for having a pattern printed thereon, the sheet capable of being positioned on material for viewing the pattern with respect to the material; and at least a pair of alignment designators positioned on the sheet for marking the material, wherein the marking facilitates alignment of the material in a support frame adapted for use when embroidering the pattern on the material.

2. The apparatus as recited in claim 1, wherein the sheet has a substantially rectangular configuration for facilitating the printing of the pattern on the sheet using a printer.

3. The apparatus as recited in claim 1, wherein the sheet is flexible for facilitating the printing of the pattern on the sheet using a printer.

4. The apparatus as recited in claim 1, wherein the alignment designators include cut outs formed in the sheet.

5. The apparatus as recited in claim 1, further comprising a label adhered to the sheet for allowing a printer to print information relating to the pattern thereon.

6. The apparatus as recited in claim 5, wherein the label is removably positioned on the sheet.

7. The apparatus as recited in claim 5, wherein the sheet is transparent and the label is opaque.

8. A method for facilitating embroidery alignment comprising:

printing a pattern on a sheet of transparent material;

positioning the sheet on a piece of material for viewing the pattern with respect to the material;

marking the material using the sheet to reflect where the pattern is to be embroidered on the material; and aligning the marking on the material with a support frame for embroidering the pattern on the material.

9. The method as recited in claim 8, wherein the sheet has a substantially rectangular configuration for facilitating the printing of the pattern on the sheet using a printer.

10. The method as recited in claim 8, further comprising printing information relating to the pattern on the sheet.

11. An apparatus, comprising:

a transparent sheet having a template defined thereon, wherein the template is adapted for having a pattern printed thereon; and at least a pair of alignment designators positioned on the template of the sheet for marking material, wherein the marking facilitates alignment of the material in a support frame adapted for use when embroidering the pattern on the material.

* * * * *